US006745904B1

(12) United States Patent
Komar et al.

(10) Patent No.: US 6,745,904 B1
(45) Date of Patent: Jun. 8, 2004

(54) DISPLAY RACK FOR INFLATED BUOYANT NOVELTY BALLOONS

(75) Inventors: Samuel B. Komar, Crystal Lake, IL (US); Steven B. Frank, Elgin, IL (US)

(73) Assignee: CTI Industries Corporation, Barrington, IL (US)

( * ) Notice: Subject to any disclaimer, the term of this patent is extended or adjusted under 35 U.S.C. 154(b) by 0 days.

(21) Appl. No.: 09/478,639

(22) Filed: Jan. 6, 2000

(51) Int. Cl.[7] ..... A47F 5/01; A47F 5/04

(52) U.S. Cl. ..... 211/13.1; 211/86.1; 211/181.1

(58) Field of Search ..... 211/85, 31, 86.01, 211/181.1, 13.1, 60.1, 133.5, 106; 446/220, 222, 223

(56) References Cited

U.S. PATENT DOCUMENTS

| | | | | | |
|---|---|---|---|---|---|
| 260,102 | A | * | 6/1882 | Langenbach | 12/115.6 |
| 642,780 | A | * | 2/1900 | Bernard | 211/85.12 |
| 1,580,847 | A | * | 4/1926 | Moineau | 248/302 |
| 1,623,919 | A | * | 4/1927 | Hagen | 248/317 |
| 1,689,070 | A | * | 10/1928 | Elliott | 40/666 |
| 2,723,036 | A | * | 11/1955 | Temple | 211/59.2 |
| 3,186,673 | A | * | 6/1965 | Olson | 248/309.4 |
| 3,726,415 | A | | 4/1973 | Malik | |
| 5,024,011 | A | | 6/1991 | Collins | |
| 5,035,391 | A | | 7/1991 | Steele et al. | |
| 5,036,985 | A | * | 8/1991 | Lovik | 211/13.1 |
| 5,074,510 | A | | 12/1991 | Metz | |
| 5,188,314 | A | | 2/1993 | Peters | |
| 5,330,120 | A | * | 7/1994 | Tussing | 242/588.2 |
| 5,449,076 | A | * | 9/1995 | Van Noord | 211/59.3 |
| 5,533,285 | A | | 7/1996 | Skistimas et al. | |
| 5,568,875 | A | | 10/1996 | Johnson et al. | |
| 5,573,437 | A | | 11/1996 | Van Dyke et al. | |
| 5,755,419 | A | | 5/1998 | Gearhart et al. | |
| 5,823,365 | A | | 10/1998 | Page | |
| D400,372 | S | | 11/1998 | Poderis | |
| 5,865,325 | A | * | 2/1999 | Comstock | 211/181.1 |
| 6,076,758 | A | * | 6/2000 | Kieves et al. | 242/400.1 |
| 6,109,462 | A | * | 8/2000 | Emalfarb et al. | 211/119 |
| 6,238,259 | B1 | | 5/2001 | Medina | |

FOREIGN PATENT DOCUMENTS

| | | |
|---|---|---|
| WO | WO 98/01844 | 1/1998 |

* cited by examiner

*Primary Examiner*—Gregory J. Strimbu
(74) *Attorney, Agent, or Firm*—Marshall, Gerstein & Borun LLP

(57) ABSTRACT

A balloon rack for buoyant balloons displays balloons at approximately eye level in a neat, untangled and orderly fashion, by providing an elongated retention slot for securely receiving a balloon weight secured to the lower end of each balloon's tether. The elongated retention slot can retain various types of balloon weights, including spool-shaped balloon weights, within the slot, and the rack can be mounted to a panel or flat surface. Alternately, the rack may be free-standing.

6 Claims, 1 Drawing Sheet

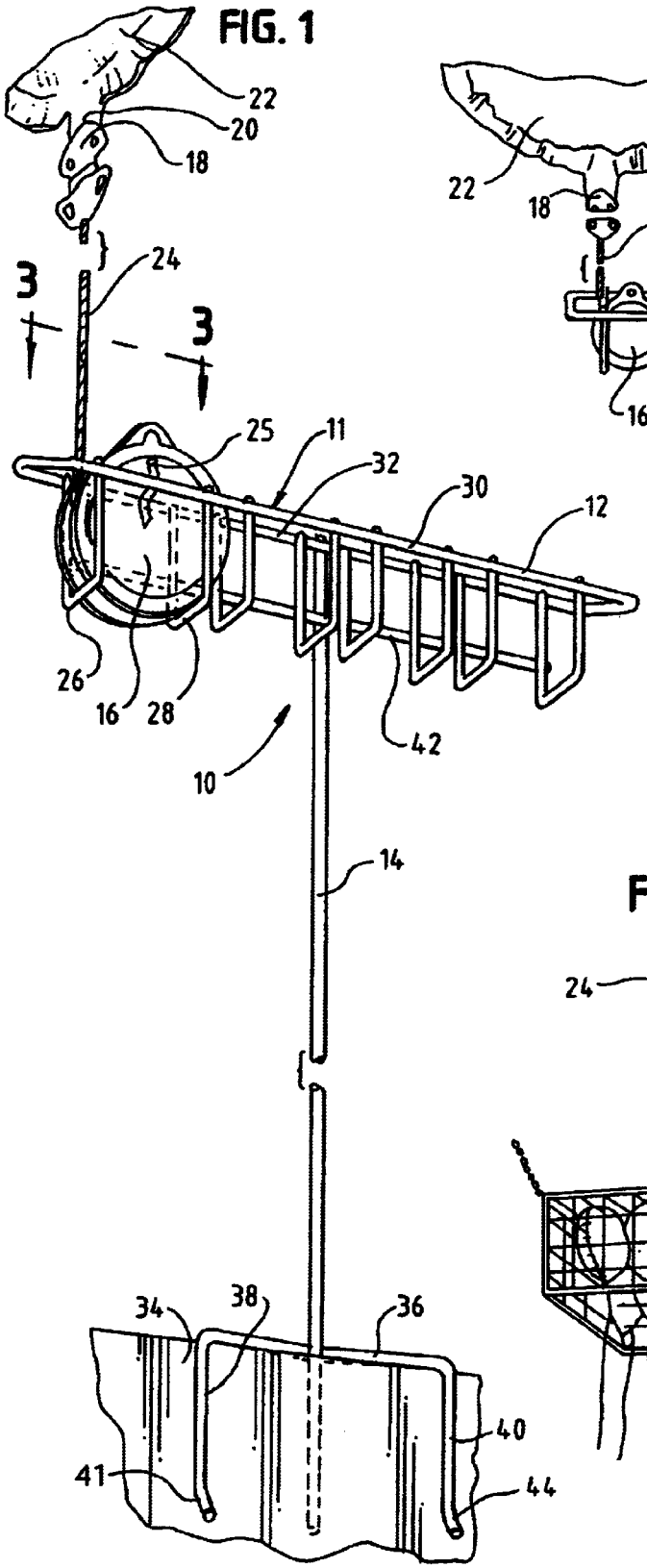
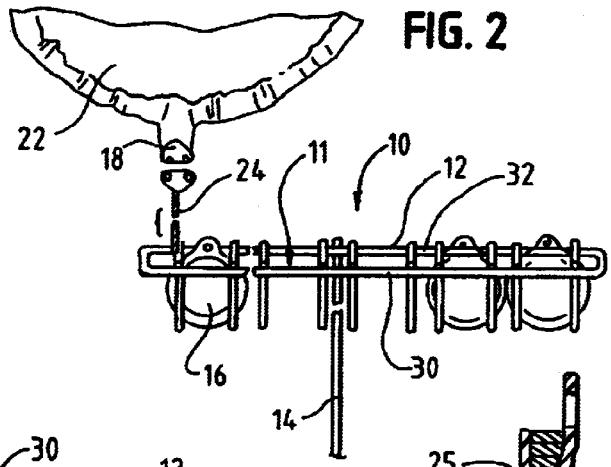
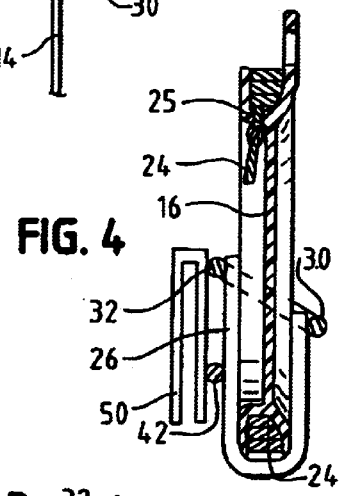
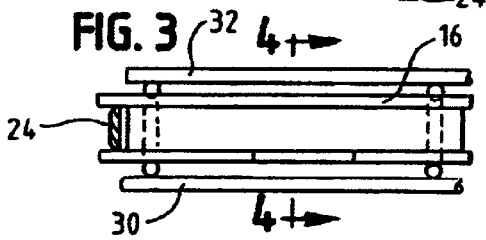
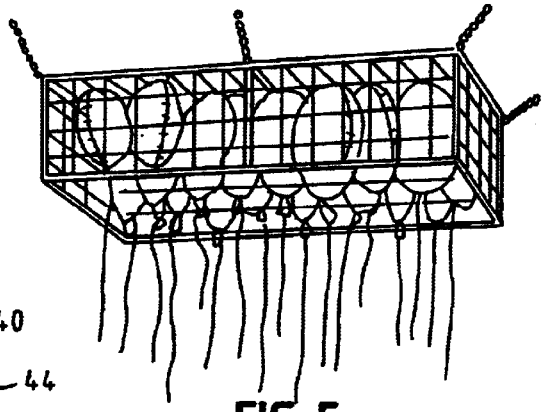
FIG. 5
PRIOR ART

DISPLAY RACK FOR INFLATED BUOYANT NOVELTY BALLOONS

BACKGROUND

1. Field of the Invention

This invention relates generally to articles for displaying retail merchandise and, more specifically, to display racks for prominently retaining and presenting helium-filled novelty balloons generally at eye level in a neat, untangled, and orderly fashion in retail settings.

2. Description of the Prior Art

The increasing popularity of lighter-than-air balloons, such as helium-filled balloons, presents a unique problem for retailers. By their nature, these buoyant balloons are difficult to display in a manner that makes it easy for the consumer to see the graphics on the face of the balloons. One widely-used device for displaying helium balloons consists of a so-called "Balloon Corral®," such as a confined area delimited by fishline, suspended, for example by chains, at or some distance just below the ceiling of a retail establishment (see FIG. 5). Such a "Balloon Corral®" keeps the balloons from blowing and moving around the store. Once a consumer selects a balloon, the balloon can be removed from the corral for purchase by pulling down on the tether, i.e., the string or ribbon affixed to the inflation opening in the bottom of the balloon, until the balloon sinks below the outer frame of the corral.

Such a "Balloon Corral®" has many serious shortcomings. First, because the "Balloon Corral®" is mounted at or near the ceiling, the balloons are typically 10 to 12 feet above the floor, which makes it difficult for consumers to see the graphics printed on the faces of the balloons, and to see which tether line belongs to a desired balloon, in order to select one or more desired balloons. Consumers have to strain their necks to look upward toward the ceiling at the balloons in the "Balloon Corral®", and some consumers have difficulty reaching the balloon tethers. Since most of the graphics of the balloons are printed on the generally flat front and rear faces of the typical mylar-type novelty balloons, the haphazard placement of balloons in the corral may hide the graphics. This requires consumers to pull on the balloon tethers to rearrange the balloons in order to see the graphics of each of the inflated balloons on display. Also, the balloons with graphics for different seasonal themes and sentiments are typically mixed together. Frequently, balloons are accidentally pulled out of the Balloon Corral® by consumers to allow viewing of the graphics. Then, if the consumer does not desire a particular balloon, he or she may simply release the tether, allowing the balloon to rise to blow around on the ceiling of the retail establishment outside the Balloon Corral®.

This can be particularly problematic, for example in drug stores, discount stores, convenience stores, and grocery stores, in which novelty items such as balloons may be in a corral in a floral or greeting card department, while a food aisle is only a few yards away. The high ceilings of the growing number of warehouse-style bulk merchandise club stores also make it difficult to retrieve errant balloons, even by their tethers, once the balloons are released from the corrals. Air conditioning systems also have a tendency to blow balloons out of the corrals. Another drawback to the Balloon Corral® is that sensitive motion detectors in many retail store security systems have a tendency to trigger false intruder alarms due to any movement of the balloons within the corrals, needlessly dispatching security personnel or police officers to the retail location. Yet another drawback to the Balloon Corral® is the difficulty of servicing it, such as when balloon tethers become tangled in the fish line, because of the corral's proximity to the ceiling. A high ladder or automatic lift device is required, which may not be readily available at the retailer's facility.

Another type of rack for displaying balloons is shown in U.S. Design Pat. No. D 400,372. That design patent shows a two-tiered rack, both tiers being generally square, and having a downwardly-open clamp below the lower tier, with a threaded bolt, for mounting the rack. The apparent manner of use of the balloon rack shown in that design patent is to tie each balloon tether to one of the outwardly-projecting, upwardly-bent flanges provided on the lower tier only, with the relatively larger and higher second tier being used to separate the balloon tethers from one another to avoid tangling.

While such a balloon rack permits display of buoyant balloons at a generally lower height than that of the "Balloon Corral®", it requires tying the tether of the balloon to the lower tier for securement. Since most balloon tethers are string or ribbon, the tying for securement and untying by the consumer often undesirably frays the tether, or simply permits them, if not properly re-tied to the rack, to undesirably float up to the store's ceiling.

Recently, balloon weights have become commonplace as the desired devices for securing lighter-than-air balloons against floating to the ceiling of retail establishments, and later, as convenient handles for the ultimate consumer. One such balloon weight has a circular profile and is in the shape of a spool, wherein a lowermost end of the tether is secured to or near the center of the spool, such as the type of balloon weight shown in U.S. Pat. No. 5,188,314. Another spool-type balloon weight is available from Premium Balloon Accessories® of Sharon Center, Ohio under the trade name "Premium Ribbon Weight™". The balloon weight of Premium Balloon Accessories can be used to selectively release desired lengths of the tether of the balloon and provide a useful handle for consumers, including children, to hold the balloon and prevent it from floating away when they exit the retail building.

The Premium Ribbon weights initially includes a flat plastic balloon coupling member integral with a generally spool-shaped plastic disc. A V-shaped weakened groove is provided along the area of attachment between the balloon coupling member and the spool-shaped disc. The balloon coupling member includes a double-sided adhesive strip on one side thereof, and a ribbon-receiving aperture or slit is provided in the center of the coupling member. One end of a length of ribbon is secured through the ribbon-receiving aperture, looped about the balloon coupling member, and secured to the balloon coupling member by a first side of the double-sided adhesive strip.

Prior to attachment to the inflation valve or opening of a balloon, the balloon coupling member is broken away from the spool-shaped member by snapping the two components apart along the weakened V-shaped groove. The second side of the double-sided adhesive strip is provided with a removable backing, so that the second side can be exposed when the backing is removed for adhesive attachment of the balloon coupling member to a balloon. The remainder of the length of ribbon is tightly wrapped in the spool, and the opposite end of the ribbon extends through the inner-most portion of the spool and provided with a knot to prevent the balloon from floating away from the spool-type weight.

Other spool-type balloon weights having circular, or even other shaped profiles, simply have an extension with an aperture, or eyelet, to receive a lowermost tied end of the tether. It would be desirable for a balloon display rack to accommodate such balloon weights and provide a convenient, easy to use location for retailers to mount balloons in a way that facilitates viewing of the graphics on each balloon's faces. The Premium Ribbon Weight™ device also has such an eyelet integral with the spool-shaped disc, which could be used for tying additional balloons to the weight, or to hook the balloon weight onto certain conventional balloon racks.

SUMMARY OF THE INVENTION

The display rack of the present invention provides an elongated, upwardly-open balloon weight retention slot that accommodates several balloon weights, for example spool-type balloon weights of many sizes, types and designs, in a side-by-side fashion. Although it is understood that the retention slot of the balloon display rack of the present invention can be used with various types of balloon weights, and that the invention is not limited to use with spool-type balloon weights, the invention works particularly well with spool-type balloon weights, so more detailed description as to its use with spool-type balloon weights is provided.

Each spool-type balloon weight preferably has an inflated helium-filled balloon tethered to it, with a short length, i.e. generally about five to twelve inches of the balloon tether, exposed. The elongated retention slot can be secured at the top of a rod or support arm, which is provided at its lower end with means for securing the rack to, for example, the top wall of a greeting card display unit or otherwise to a similar thin, flat, and sturdy upright panel member. Alternatively, the means for securing the rack to upright panels or other surfaces can be provided directly on the frame of the elongated retention slot. In one exemplary form of the present invention, the rack is made of laminated wire and the means for securing the rack to the top wall of a greeting card display or similar sturdy panel includes two wire extensions that project forwardly or rearwardly of a central rod, so that a thin gap is created between the rod and the wire extensions to securely receive the wall or thin panel therebetween.

Within the elongated retention slot, pairs of spaced-apart generally U-shaped or J-shaped wires extend downwardly from front and rear wires at the top of the elongated slot. Each pair of U-shaped or J-shaped wires generally supports one spool-type balloon weight in the retention slot formed therein. It will be appreciated by those of ordinary skill in the art that by increasing the length of the elongated slot, and increasing the number of pairs of U-shaped or J-shaped wires in the elongated slot, more balloons can be displayed on a given rack.

Although the balloon weights are supported in a side-by-side orientation, the girth of the inflated balloons is sufficient to keep the balloon tethers from becoming entangled with one another, particularly when only a relatively short length of tether, e.g. five to twelve inches, is released or unwound from the spool-type balloon weight. It is also possible to mount balloons on the rack with alternating lengths of balloon tethers exposed, so that the mounted balloons are at alternating heights and their graphics are more visible to consumers. The features and benefits of the present invention are explained in greater detail in the following detailed description of the preferred embodiment, the drawings, and the claims.

DESCRIPTION OF THE DRAWINGS

FIG. 1 is a perspective view of a balloon rack, partially broken away, of the present invention, in combination with one balloon, broken-away, tethered to a short length of ribbon unwound from a spool-type balloon weight;

FIG. 2 is a front plan view of the balloon display rack of FIG. 1;

FIG. 3 is a top view taken along lines 3—3 of FIG. 1;

FIG. 4 is a left side view of the balloon display rack of FIG. 1; and

FIG. 5 is a perspective view of a prior art "balloon corral".

DETAILED DESCRIPTION OF THE PREFERRED EMBODIMENT

With reference to FIGS. 1 and 2, a balloon display rack 10 of the present invention includes an elongated balloon weight retention slot 11, which is in the form of a channel or gutter, at the upper end of a main support arm 14. The elongated slot 11 is defined by a frame 12, which is adapted with means for receiving several balloon weights 16. It will be appreciated by those of ordinary skill in the art that the balloon weight 16 may take on various forms, including cards, paper or cardboard hangers, toys, games, or any other item that has adequate weight to hold a balloon on the display rack. In this disclosure and the drawings, a spool-type balloon weight is described in detail, but the display rack of the present invention is not limited to use only with spool-type balloon weights.

In one spool-type of balloon weight 16, e.g. the "Premium Ribbon Weight™" available from Premium Balloon Accessories®, a flat balloon interface member 18 is adhesively secured to the balloon neck valve or opening 20 of an inflated buoyant balloon 22 using double-stick adhesive (not shown). An upper end of a balloon tether 24, such as a string or ribbon, is looped around the mid-section of the balloon interface member 18, and secured thereto with the double-stick adhesive (not shown).

A lower end of the balloon tether 24 is wrapped around the spool of the circular balloon weight 16, and extends through an aperture 25 in the spool. A knot in the balloon tether 24 that is larger than the aperture 25 prevents the balloon tether 24 from floating away from the balloon weight 16.

A means for receiving each of the generally circular balloon weights 16 takes the form of a pair of spaced, generally U-shaped wires 26, 28 that extend downwardly from the front 30 and rear 32 of the frame 12 defining the elongated slot 11. In the preferred embodiment shown in the drawings, the front 30 of the frame 12 is disposed lower than the rear 32, so that the frame 12 is sloped downward toward the front of the rack 10. The U-shaped wires 26, 28, as best shown in FIG. 4, are thus more accurately described as J-shaped in this specific embodiment, but for the purposes of this disclosure the term U-shaped shall be defined to include J-shaped within its meaning. While this sloped orientation of the frame 12 facilitates ready insertion and removal of balloon weights 16, it is recognized that the frame 12 may instead have a generally flat orientation. Each of the U-shaped wires 26, 28 is attached at the upper ends thereof to the elongated slot 11, for example by being welded to the inside perimeter of the elongated slot 11.

While in the preferred embodiment the elongated retention slot 11 is horizontally-oriented, i.e. so as to display balloons 22 in a row formation, it is recognized that the slot 11 could instead be on an incline, so that balloons 22 are displayed on the rack 10 in a rising, step-wise fashion (not shown).

The main support arm 14 is shown to extend downwardly from the rear 32 of the frame 12 of the elongated slot 11, and includes attachment means at a lower end thereof for securing the rack 10 to a generally flat, sturdy panel 34, such as the top or rear edge of a greeting card display rack. It will be appreciated that the main support arm 14 can instead extend horizontally from, upwards from, or even at an angle from the rear 32 of the frame 12 of the elongated slot 11. Furthermore, multiple frames 12 could be provided on a single main support arm 14, facilitating a display of balloons that takes the form of a large bouquet of balloons. Such multiple frames (not shown) could be oriented parallel to one another, or perpendicular to one another, or even at various angles. The means for securing the rack 10 to the generally flat panel 34 includes an inverted U-shaped wire member 36 that is attached to the main support arm 14 adjacent and above a lowermost end of the main support arm 14. The inverted U-shaped wire member 36 includes a pair of downwardly-depending legs 38, 40 oriented parallel to one another, but offset relative to the main support arm 14. While in the specific embodiment shown in the drawings the legs 38, 40 are shown to extend forwardly of the main support arm 14, it is recognized that the legs 38, 40 could alternatively extend rearwardly of the main support arm 14.

The offset of the legs 38, 40 and the main support arm 14 defines a gap into which the generally flat panel 34 may be securely received. A lowermost end 41, of each of the legs 38, 40, respectively, is angled forward, i.e. in a direction opposite the main support arm 14. This bend or incline at the lowermost ends 41 of the legs 38, 40 provides a relatively wider opening for the securement means, which facilitates installation of the rack 10 on the generally flat panel 34. Yet other attachment means could include attaching a "C" clamp to the bottom of the main support arm 14; or the use of screw eyes formed at one or two locations on the lower end of the main support arm 14, to allow bolting or screwing to a shelf panel, to the wood trim of a wall, or to a table or counter at a point-of-sale station.

A reinforcement wire 42 may be attached near a lower end of the U-shaped wires 26, 28 (i.e., intermediate the rear 32 of the frame 12 and the bottom of each of the U-shaped wires 26, 28) to connect all the U-shaped wires 26, 28 to one another. Importantly, as shown in FIG. 4, the balloon display rack 10 of the present invention could be produced without the main support arm 14, such that the elongated retention slot 11 and the U-shaped wires 26, 28 would effectively define the entire body of the balloon display rack 10. In such an embodiment, the frame 12 could be directly provided with means 50 for mounting the rack to an upright panel or other desired surface. In FIG. 4, the means 50 for mounting the frame 12 to an upright panel takes the form of one or more inverted U-shaped mounting members attached, e.g. by welding, to the rear 32 of the frame 12 and the reinforcement wire 42.

Other equivalent attachment means 50 include, for example, screws extending through tabs having screw-receiving apertures (not shown) provided on the rear 32 of the frame 12 (instead of the inverted U-shaped mounting members); adhesive provided along a vertically oriented plate attached to the rear 32 of the frame 12 and to the reinforcement wire 42; rearwardly-directed wire extensions (not shown) of parts of the frame 12, e.g. extensions of the U-shaped wires 28 or extensions of the sides of the frame 12, that could be securely received in a pegboard; or even hooks or clamps placed on the rear 32 of the frame 12 that are used in conjunction with metal or plastic eyes screwed onto the desired surface or panel. Those of ordinary skill in the art will appreciate that many other means for attachment of the elongated slot to a panel or surface are possible, and are considered within the scope of the present invention. Alternatively, it is recognized that the balloon display rack may have its own base (not shown) by which to mount the main support arm 14, so as to be free standing.

Importantly, the elongated slot 11 of the display rack 10 may be of any given length selected by the manufacturer, so that different racks can be made for accommodating different quantities of balloons. The elongated slot 11 can also be made of varying widths, in order to accommodate different sized or shaped balloon holders. Furthermore, the rack 10 can advantageously be mounted side-by-side, back-to-back, or in still other configurations, with other racks 10 of the present invention for further unique balloon display arrangements. As such, the use of the display rack 10 is not limited to the retail setting, but may be extended to decorative use at parties, sporting events, or trade shows for facilitating the design of large unique balloon centerpieces and other balloon displays.

While the entire rack 10 may be made of laminated steel wire (except, preferably, for unlaminated steel areas where welds occur), it is also recognized that various other materials (e.g., injection molded plastic, corrugated board, or cardboard) may be used to construct the rack 10 and the present invention is not limited to a particular material. While the invention has been described with respect to particular embodiments thereof, it is not intended to be limited thereto, and those of ordinary skill in the art will understand that changes and modifications may be made therein that are still within the scope of the appended claims.

What is claimed is:

1. A rack for displaying lighter-than-air balloons, said rack comprising:

an elongated slot at an upper end of said rack; and means for attaching said rack to a generally flat panel, in combination with a generally spool-shaped weight received in said elongated slot and adapted to secure a balloon tether thereto, said slot being defined by a pair of spaced, generally U-shaped members extending between a front of said elongated slot and a rear of said elongated slot, a bottom portion of each of said U-shaped members supporting a radial edge of the generally spool-shaped weight such that a portion of said generally spool-shaped weight extends below the pair of generally U-shaped members when received in said elongated slot.

2. The rack of claim 1, including a plurality of additional pairs of said generally U-shaped members, each said additional pair adapted to receive and support in an upright orientation at least one additional generally spool-shaped weight.

3. The rack of claim 2, further comprising a wire member connecting each of said U-shaped members.

4. The rack of claim 1, further comprising a main support arm extending downwardly from said rear of said elongated slot.

5. The rack of claim 4, wherein said means for attaching the rack is provided adjacent a lower end of said main support arm.

6. A rack for displaying buoyant balloons, said rack comprising:

an elongated slot at an upper end of said rack, said elongated slot having a front and a rear, said front being disposed at a lower height than said rear, and said elongated slot comprising a pair of spaced, generally U-shaped members extending between said front and said rear; and means for attaching said rack to a generally flat panel, in combination with a generally spool-shaped weight for securing a balloon tether thereto, said weight received in said elongated slot, wherein a bottom portion of each of said U-shaped members supports a radial edge of said generally spool-shaped weight such that a portion of the generally spool-shaped weight extends below the pair of generally U-shaped members.

* * * * *